United States Patent [19]

Wilson

[11] Patent Number: 4,551,615

[45] Date of Patent: Nov. 5, 1985

[54] GUARD FOR HOT AIR GUN

[75] Inventor: Peter H. Wilson, Stockton-on-Tees, England

[73] Assignee: Black & Decker Inc., Newark, Del.

[21] Appl. No.: 605,801

[22] Filed: May 1, 1984

[30] Foreign Application Priority Data

May 5, 1983 [GB] United Kingdom ..... 8312378

[51] Int. Cl.[4] ..... F24H 3/04; H05B 1/00; H05B 3/02

[52] U.S. Cl. ..... 219/373; 219/222; 219/367; 219/370; 34/96

[58] Field of Search ..... 219/367, 373, 370, 371, 219/368, 369, 222; 34/96, 97, 98, 99, 100, 101

[56] References Cited

U.S. PATENT DOCUMENTS 3,943,329 3/1976 Hlavac ..... 219/367

OTHER PUBLICATIONS

Kamweld Products Co., Inc., "*Ready Welder*" *for Plastics;* 1973.

*Primary Examiner*—C. L. Albritton
*Assistant Examiner*—M. M. Lateef
*Attorney, Agent, or Firm*—Ronald B. Sherer; Edward D. Murphy; Harold H. Weinstein

[57] ABSTRACT

A hot air gun having a hot air outlet is provided with a guard plate having a substantially straight edge transverse to the general direction of the hot air flow. This straight edge is downstream of the hot air outlet and defines the downstream extremity of the guard plate, the latter defining the boundary on one side of the hot air flow from the outlet. Preferably the guard plate has a flared flat part and a tubular part, the latter being detachably and rotatably mounted around the outlet. The guard plate is advantageously used when stripping paint adjacent a glass pane to minimize heating of the glass.

13 Claims, 4 Drawing Figures

GUARD FOR HOT AIR GUN

FIELD OF THE INVENTION

This invention relates to a guard for a hot air gun, to a gun incorporating such a guard and to a method of applying hot air to a surface while guarding an area adjacent to said surface from the hot air.

BACKGROUND OF THE INVENTION

Hot air guns have a variety of applications, an important one of which is stripping paint from a surface. When stripping paint from a window frame for example it is important that the heat of the air blown from the gun should be sufficient to strip the paint effectively but that the heat should not be great enough to crack the glass.

In a known form of hot air gun the heat generated by the gun can be controlled and the rate of flow of hot air can also be controlled. While such an arrangement overcomes the difficulty mentioned above to some extent, problems may still arise where paint is to be stripped from an area immediately adjacent to glass or some other temperature sensitive material.

SUMMARY OF THE INVENTION

It is an object of the invention to provide a guard for a hot air gun.

It is another object of the invention to provide a gun incorporating such a guard.

It is another object of the invention to provide a method of applying hot air to a surface while guarding an area adjacent to said surface from the hot air.

According to the invention there is provided a guard for a hot air gun, the guard including a substantially straight edged guard plate and means for attaching the guard to a hot air gun such that the substantially straight edge of the guard plate is downstream of a hot air outlet of the gun and the guard plate defines, in use, part of the boundary of the hot air flow from the outlet.

By placing the guard of the invention with its straight edge up against the edge of a surface to be stripped of paint it is possible to reduce very considerably the heating of the area outside the guard. By providing a straight edge to the guard plate the latter can be placed in close contact with a planar surface thus enhancing the protective action of the guard.

An important feature of the present invention is that the guard is able to be attached to the hot air gun. As a result, when the gun and guard are in use an operator requires only one hand to operate both the gun and guard and therefore has one hand free which may for example be used for operating a scraper to scrape away paint heated by the gun.

Preferably the substantially straight edge of the guard plate is substantially longer than a transverse dimension of the hot air outlet of the gun. This improves the effectiveness of the guard since the possibility of hot air passing around the edge of the guard is reduced.

The guard plate may flare outwardly towards its substantially straight edge. The necessary width of the guard plate increases with distance from the hot air outlet and with proximity to the area to be guarded so that an outwardly flaring shape for the guard plate is preferable. In one embodiment of the invention the guard plate is substantially semicircular in shape.

The means for attaching the guard to a hot air gun may comprise a generally tubular part for fitting around the hot air outlet. The tubular part may have a longitudinal slot whereby it can be expanded to fit over a cylindrical mounting on the gun around the hot air outlet. The use of a tubular part to attach the guard to a hot air gun also has the advantage, if the tubular part is circular, that the guard can be rotatably mounted for rotation around the hot air outlet to adjust the position of the guard as the user desires.

The guard plate may be disposed in a plane substantially tangential to the tubular part. With such an arrangement, in the case where the tubular part is attached to the gun immediately around the hot air outlet, the guard plate forms a smooth extension of the hot air outlet not impeding the air flow, and in use the region immediately inside the guard plate is at a high temperature comparable to temperatures elsewhere in the hot air flow from the outlet, while the region immediately outside the guard plate is very much cooler. Thus the guard plate provides a well defined boundary to the hot air flow.

According to another aspect of the invention there is provided a hot air gun having a hot air outlet and including a guard plate with a substantially straight edge transverse to the general direction of hot air flow, downstream of the hot air outlet of the gun and defining the downstream extremity of the guard plate, the guard plate defining in use part of the boundary of the hot air flow from the outlet.

Preferably the guard plate is detachably mounted on the gun and in this case the guard plate may be part of a guard as defined above. This has the advantage that when the guard is not required it can be dispensed with so that there is no possibility of it impeding the user. If desired, however, the guard plate may be an integral part of the gun.

The gun preferably has a further air outlet around the hot air outlet for a flow of cooling air and the guard plate is preferably positioned on the gun between the flow paths of the hot air and cooling air. This arrangement is particularly advantageous as the area being guarded from the hot air flow is cooled by the cooling air flow and the temperature of the guard itself is also reduced by the cooling air flow.

According to another aspect of the invention there is provided a method of applying hot air to a surface while guarding an area adjacent to said surface from the hot air, the method including the steps of providing a hot air gun having a hot air outlet and including a guard plate with a substantially straight edge, and operating the gun by directing the hot air from the outlet at said surface while holding the gun with the substantially straight edge at the boundary between said surface and said area to be guarded whereby the guard plate protects said area from the hot air from the outlet.

The flow of cooling air may be passed out of the gun around the hot air and the guard plate may be positioned on the gun between the flows of hot air and cooling air.

Other objects, features, and advantages of the present invention will become more fully apparent from the following detailed description of specific embodiments, the appended claims, and the accompanying drawings.

DETAILED DESCRIPTION OF THE PREFERRED EMBODIMENT

Figure 1:
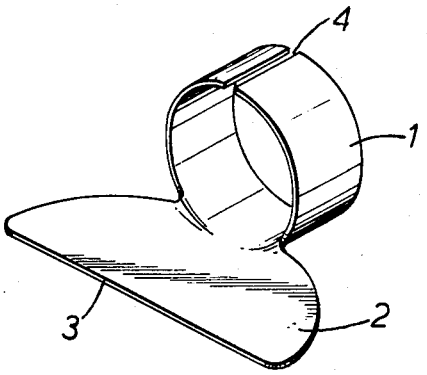
FIG. 1 is a perspective view of the guard.

The guard shown in FIG. 1 is made of metal and has a tubular part 1 and an integral guard plate 2 lying in a plane tangential to the tubular part 1 and having a straight edge 3 which has a length of a little over twice the diameter of the tubular part 1. The tubular part 1 has a longitudinal slot 4. The guard plate flares outwardly towards the straight edge 3 and is substantially semi-circular in shape.

Figure 2:
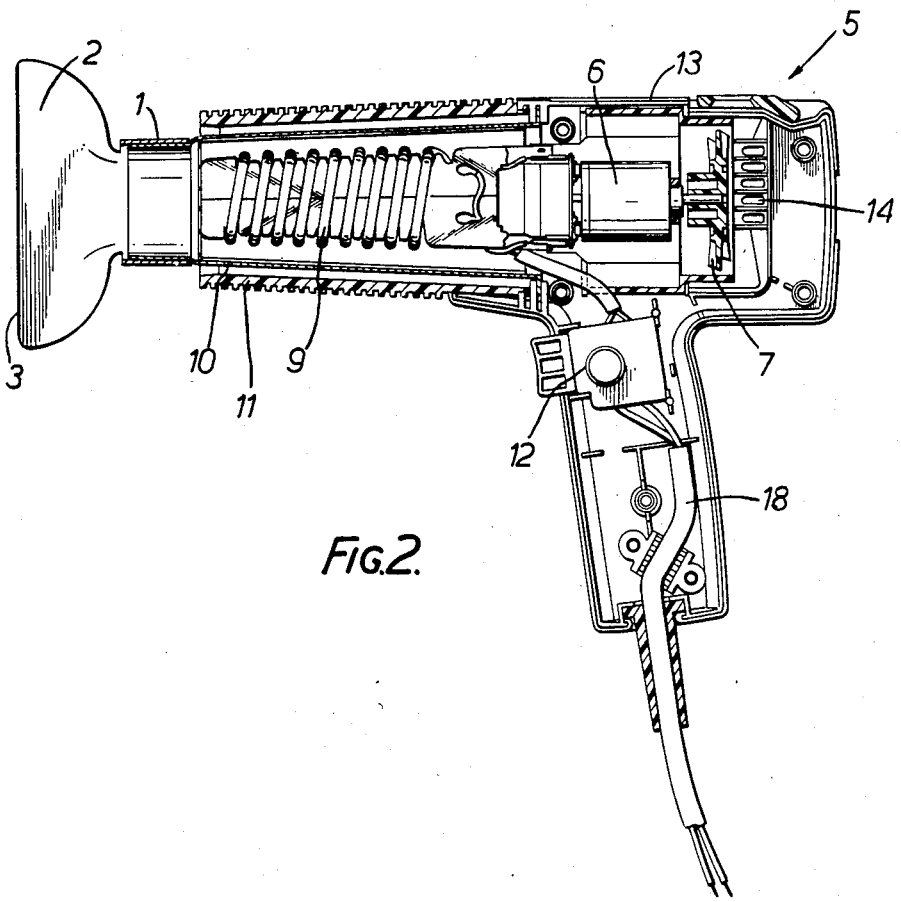
FIG. 2 is a sectional side view of the hot air gun with the guard of FIG. 1 attached in a first orientation.

The hot air gun 5 shown in FIG. 2 has a casing 13 of clam shell construction, an electric motor 6, a fan 7, a heating element 9, an inner tube 10, an outer tube 11, an operating switch 12 and an electric cable 18 for connecting the gun to a power source. To the rear of the fan 7 inlet air vents 14 are provided. When the switch 12 is activated power is supplied to the heating element 9 and also, after rectification if appropriate, to the motor 6, which is a permanent magnet D.C. motor. Rotation of the motor 6 drives the fan 7 which creates an air flow in through the air vents 14, over the motor 6 and into the tubes 10 and 11. The main air flow passes through the inner tube 10 and is heated by the heating element 9, while a subsidiary air flow passes between the outer tube 11 and the inner tube 10. The subsidiary air flow acts as a cooling air flow preventing the outer tube 11, parts of which are exposed, from becoming too hot.

The details of the hot air gun shown in FIG. 2 beyond those described above are not important to the present invention and need not be described further. A fuller description of the gun is contained in my pending U.S. patent application Ser. No. 587,704, filed Mar. 8, 1984, the disclosure of which is hereby incorporated herein by reference. A gun similar in broad principle to that described above is described in British patent specification No. 803,329 in the name of Patrick Clement Cox.

Figure 3:
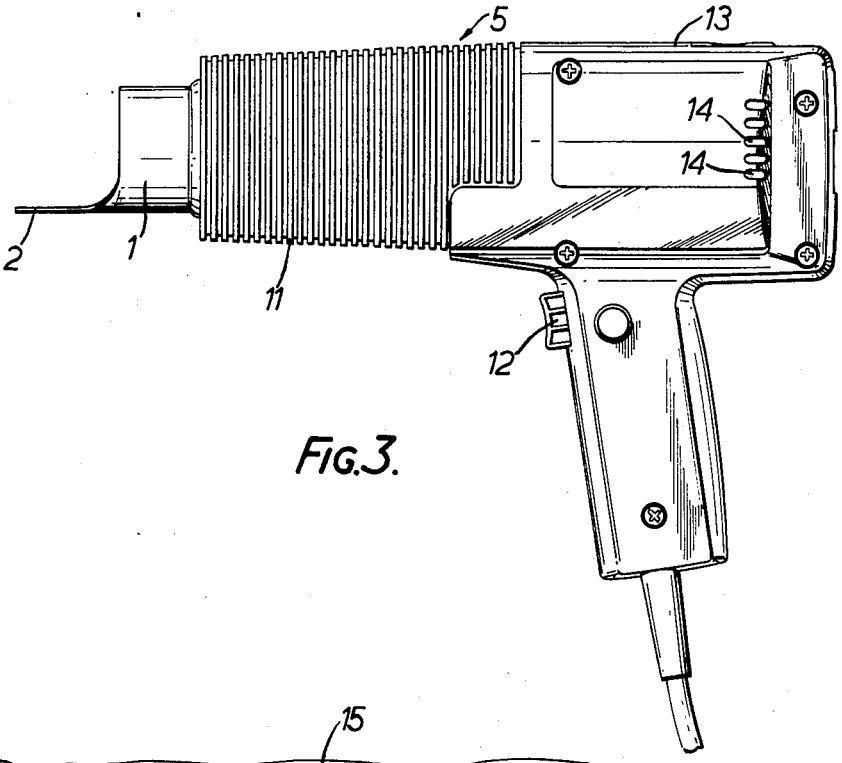
FIG. 3 is a side view of the hot air gun and guard of FIG. 2 with the guard attached in a second orientation.

The guard of FIG. 1 is attached to the hot air gun 5 by pushing the tubular part 1 over the inner tube 10. The natural size of the inside of the tubular part 1 is slightly smaller than the outside of the tube 10, so that the tubular part expands slightly during this process and the guard is thereby held firmly in place. In FIG. 2 the guard plate is shown in one particular orientation in which, with the gun in a normal upright position, the guard plate 2 is vertical, but it should be understood that it may be rotated relative to the tube 10 to any desired orientation. Another orientation which may often prove useful is that shown in FIG. 3. In this case, with the gun in its normal position, the guard plate 2 is horizontal.

When using the gun 5 to strip paint close to a pane of glass, the hot air outlet of the gun is directed at the paint with the guard attached and the straight edge 3 of the guard plate 2 lying along, or just on the painted side of, the boundary between the paint and the glass. Hot air exiting from the inner tube 10 is then confined by the guard plate 2 predominantly to the painted area and heating of the glass is substantially reduced. Furthermore, the cooling air flow emerging between the tubes 10 and 11 passes along the outside of the guard plate 2 and therefore has a cooling action on the glass and also on the guard plate. The guard plate 2 only affects the air flow on the side on which it is located and does not otherwise affect the air flow.

Figure 4:
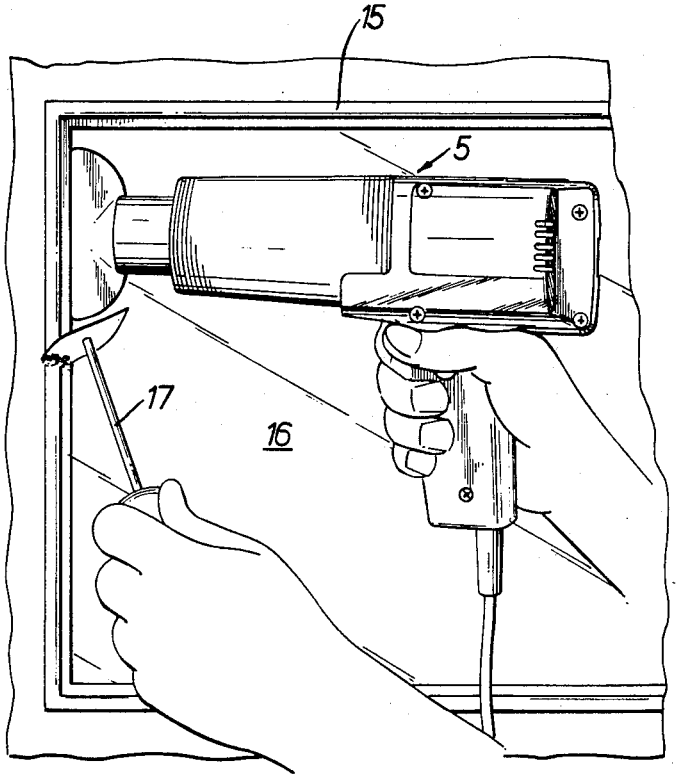
FIG. 4 is a perspective view of the combination of FIG. 2 in use.

FIG. 4 shows the gun being used to strip paint on a window frame 15 close to a glass pane 16. Because the guard is attached to the hot air gun 5, a user requires only one hand to operate the gun. The other hand can therefore be used for example to operate a scraper 17 as shown in FIG. 4.

If desired the guard may be designed so that its straight edge can be used in the manner of a blade to strip paint.

While the use of the guard when stripping paint has been described, it should be understood that the guard may also be used on a hot air gun that is being used for other purposes.

The above described embodiments, of course, are not to be construed as limiting the breadth of the present invention. Modifications, and other alternative constructions, will be apparent which are within the spirit and scope of the invention as defined in the appended claims.

What is claimed is:

1. A hot air gun, comprising:

a housing having an outlet for a flow of hot air therefrom;

a guard plate in the vicinity of said hot air outlet, said guard plate being connected to said housing;

said guard plate having a straight edge transverse to the general direction of said hot air flow, said straight edge being located downstream from said outlet and defining the downstream extremity of said guard plate;

said guard plate defining in use part of the boundary of said hot air flow from said outlet; and a cooling air outlet for a flow of cooling air therefrom, said cooling air outlet being disposed around said hot air outlet and said guard plate being positioned between the respective flow paths of said hot air flow and said cooling air flow.

2. The hot air gun of claim 1, wherein said guard plate is detachably mounted on the gun.

3. The hot air gun of claim 1, wherein said guard plate has a tubular part which is detachably mounted on the gun around said hot air outlet.

4. The hot air gun of claim 1, wherein said guard plate is rotatable around said hot air outlet.

5. The hot air gun of claim 3, wherein said guard plate is disposed in a plane substantially tangential to said tubular part.

6. The hot air gun of claim 1, wherein said guard plate flares outwardly towards said straight edge.

7. The hot air gun of claim 6, wherein said guard plate is substantially semi-circular in shape.

8. A hot air gun, comprising:

a housing having a handle depending therefrom;

an inner tube extending from said housing and terminating in an outlet;

means, disposed in said housing, for directing a flow of hot air from said outlet.

an outer tube surrounding said inner tube;

means, disposed in said housing, for directing a flow of cooling air from between said inner and outer tubes and outside said outlet;

a guard plate having a flat part extending from a tubular part, said tubular part being detachably and rotatably mounted on said inner tube in the vicinity of said outlet;

said flat part lying in a plane tangential to said tubular part and having a straight edge transverse to the general direction of said hot air flow, said straight edge defining the downstream extremity of said guard plate, and said flat part flaring outwardly from said tubular part to said straight edge; and said flat part defining part of the boundary of said hot air flow from said outlet and separating said hot and cold air flows along that part of said boundary.

9. The hot air gun of claim 8, wherein said tubular part has a longitudinal slot therein whereby said tubular part can be expanded to fit over said inner tube, and said flat part is substantially semi-circular in shape. pg,15

10. A method of applying hot air to a surface while guarding an area adjacent to said surface from the hot air, comprising the steps of providing a hot air gun having a hot air outlet and including a guard plate with a substantially straight edge, and operating the gun by directing the hot air from the outlet at said surface while holding the gun with the substantially straight edge at the boundary between said surface and said area to be guarded whereby the guard plate protects said area from the hot air from the outlet.

11. The method of claim 10, wherein the guard plate is rotatable around the hot air outlet.

12. The method of claim 10, further comprising passing a flow of cooling air from the gun around the flow of hot air, and positioning the guard plate on the gun between the flows of hot air and cooling air.

13. The method of claim 10, wherein said surface is painted and said adjacent area is formed by at least part of a glass pane, and further comprising the step of striping paint from said surface adjacent said glass pane and said guard plate.

* * * * *